US008297780B2

(12) United States Patent
Emmert

(10) Patent No.: US 8,297,780 B2
(45) Date of Patent: Oct. 30, 2012

(54) INDIRECT LIGHT ASSEMBLY

(75) Inventor: Sidney Quiinn Emmert, Oklahoma City, OK (US); Sonya Emmert, legal representative, Oklahoma City, OK (US)

(73) Assignee: Dentcraft Tools Limited Partnership, Oklahoma City, OK (US)

( * ) Notice: Subject to any disclaimer, the term of this patent is extended or adjusted under 35 U.S.C. 154(b) by 0 days.

(21) Appl. No.: 13/299,830

(22) Filed: Nov. 18, 2011

(65) Prior Publication Data

US 2012/0063127 A1 Mar. 15, 2012

Related U.S. Application Data

(62) Division of application No. 12/399,791, filed on Mar. 6, 2009.

(60) Provisional application No. 61/034,770, filed on Mar. 7, 2008.

(51) Int. Cl.
*F21V 5/04* (2006.01)

(52) U.S. Cl. ..... 362/217.05; 362/311.06; 362/311.09; 362/311.1; 362/335; 362/223

(58) Field of Classification Search ..... 362/220, 362/223, 217.02–217.04, 222, 244, 307–309, 362/311.01, 311.06–311.09, 311.1, 326, 362/334–336, 340, 351, 355, 361
See application file for complete search history.

(56) References Cited

U.S. PATENT DOCUMENTS

| | | | | | |
|---|---|---|---|---|---|
| 3,760,178 | A * | 9/1973 | Miller | 362/223 |
| 4,081,665 | A * | 3/1978 | Corbeil | 362/223 |
| 4,573,111 | A * | 2/1986 | Herst et al. | 362/337 |
| 4,660,131 | A * | 4/1987 | Herst et al. | 362/223 |
| 4,722,023 | A * | 1/1988 | Arima et al. | 362/503 |
| 4,755,921 | A * | 7/1988 | Nelson | 362/307 |
| 4,870,543 | A | 9/1989 | Born et al. | |
| 4,891,737 | A * | 1/1990 | Szymanek | 362/223 |
| 4,930,051 | A * | 5/1990 | Golz | 362/522 |
| 5,023,755 | A | 6/1991 | Rosenberg | |
| 5,126,928 | A | 6/1992 | Hughes | |
| 5,424,931 | A | 6/1995 | Wheeler | |
| 5,448,464 | A | 9/1995 | Moss | |
| 5,675,417 | A | 10/1997 | Ventura et al. | |
| 6,019,484 | A | 2/2000 | Seyler | |
| 6,402,349 | B1 * | 6/2002 | Miller et al. | 362/331 |
| 6,854,862 | B1 | 2/2005 | Hopf | |
| 6,935,046 | B2 | 8/2005 | Tang et al. | |
| 7,249,870 | B1 * | 7/2007 | Shwisha | 362/368 |

* cited by examiner

*Primary Examiner* — Bao Q Truong
(74) *Attorney, Agent, or Firm* — Hall Estill Attorneys at Law; Tyler J. Mantooth

(57) ABSTRACT

An apparatus and associated method for operating a portable light assembly. In accordance with some embodiments, a frame providing a bridge and defining a transport region and a deployment region is slidingly connected to a mast. An arm is further connected to the mast by a hinge while a light fixture is connected to the arm. In various embodiments, the light fixture is capable of transitioning from a deployed position where the mast engages the deployment region and a transport position where the mast and light fixture are disposed within the transport region.

20 Claims, 10 Drawing Sheets

INDIRECT LIGHT ASSEMBLY

RELATED APPLICATIONS

The present application is a divisional of co-pending U.S. patent application Ser. No. 12/399,791 filed on Mar. 6, 2009, which makes a claim of domestic priority to U.S. Provisional Patent Application No. 61/034,770 filed Mar. 7, 2008.

FIELD OF THE INVENTION

The present invention relates generally to the field of portable light used to illuminate various surfaces.

BACKGROUND

Portable lights are often used in a commercial and residential setting to illuminate surfaces. A variety of portable lights have been proposed in the art, such as U.S. Pat. No. 6,854,862 which discloses a system that allows a user to illuminate objects with an infinitely adjustable light fixture and a knock down base frame.

These and other prior art approaches generally increase the quality of light and the functionality of adjusting the light to an infinite amount of freedom.

Nevertheless, there are limitations associated with such approaches including the ability to reduce the size of the light to an easily transportable volume. The placement of the electrical cord providing power to the light fixture has also remained an unassailable hurdle for such approaches. Likewise, the protection of the light fixture while in transport greatly limit the effectiveness and operational performance of such systems.

There is therefore a continued need for improvements to address these and other limitations in the art, and it is to such improvements that preferred embodiments of the present invention are generally directed.

SUMMARY

Various embodiments of the present invention are generally directed to an apparatus and associated method for operating a portable light assembly.

In accordance with some embodiments, a frame providing a bridge and defining a transport region and a deployment region is slidingly connected to a mast. An arm is further connected to the mast by a hinge while a light fixture is connected to the arm. In various embodiments, the light fixture is capable of transitioning from a deployed position where the mast engages the deployment region and a transport position where the mast and light fixture are disposed within the transport region.

In accordance with other embodiments, a frame having a bridge defining a transport region and a deployment region is provided. A mast is slidingly connected to the frame and an arm is connected to the mast by a hinge while a light fixture is connected to the arm. The light fixture is subsequently transitioned from a deployed position where the mast engages the deployment region to a transport position where the mast and light fixture are disposed within the transport region.

Further in other embodiments, a hinge is capable of selectively securing a first protrusion in relation to a second protrusion. The hinge encloses a cord that connects an electrical device connected to the first protrusion with a power source positioned adjacent to the second protrusion.

These and various other features and advantages which characterize the various embodiments of the present invention can be understood in view of the following detailed discussion in view of the accompanying drawings.

DETAILED DESCRIPTION

Preferred embodiments of the present invention are generally directed to a portable light suitable for use in illuminating various surfaces, such as automobile bodies or aeronautical interiors.

As discussed in greater detail below, the portable light preferably includes a novel collapsible position in which the light fixture is protected from harm.

Figure 1:
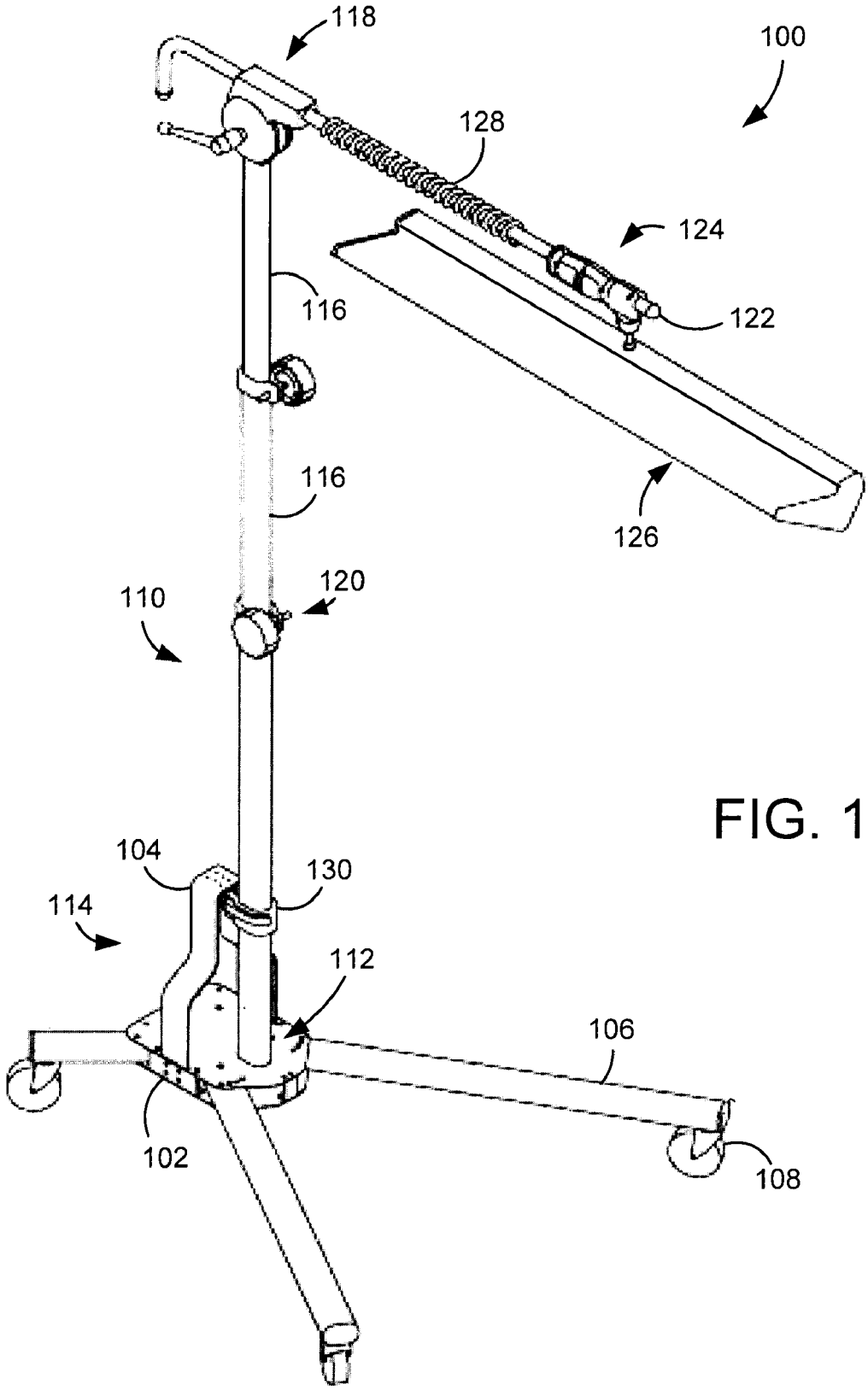
FIG. 1 provides generalized isometric representations of a portable light constructed and operated in accordance with preferred embodiments of the present invention.

Referring now to FIG. 1, a portable light assembly 100 is displayed in accordance with various embodiments of the present invention. The light assembly 100 preferably provides a base 102 that includes a bridge 104. In some embodiments, the base 102 has a plurality of legs 106 extending therefrom that can be locked in a desired position by a locking mechanism. However, the number and configuration of the legs 106 are not limiting as any number of legs can be connected to the base 102 in various orientations that provide support, as desired. Similarly, the legs 106 can be configured to include one, or many, casters 108 that allow selective movement of the base 102.

Further in various embodiments, a mast 110 is connected to the bridge 104 and is capable of being manipulated into a deployed position to which the mast 110 engages a deployment region 112 defined by the base 102 as well as the bridge 104. In contrast, the mast can also be manipulated into a transport position to which the mast 110 is disposed within a transport region 114 defined by the base 102 and bridge 104. While the mast can comprise a single unitary component, the mast can alternatively be configured to provide a number of extensions 116 that allow enhanced vertical precision of an attached hinge 118 through selected securement of one, or many, clamps 120.

In addition, the hinge 118 can be connected to an arm 122 and provide, in some embodiments, an infinite number of adjustment positions in a single plane. That is, the hinge 118 can adjust and secure the arm 122 in an infinite range of motion along a single plane. As shown in FIG. 1, the arm 122 can be connected to both the hinge 118 at a proximal end and a handle 124 at a distal end. The handle 124 is preferably selectable to adjust and secure a light fixture 126 in a desired orientation with respect to the arm 122. Various embodiments of the handle 124 connect the light fixture 126 via a ball and socket joint that allows adjustment in multiple planes.

It should be noted that the handle 124 can be adjusted and secured along the length of the arm 122 alone, or in combination, with the adjustment of the orientation of the light fixture 126. Likewise, the placement and configuration of the electrical cord 128 should be noted as providing advantageous practical adjustment of the arm 122, handle 124, and light fixture 126 due, at least in part, to the placement of the cord 128 within the mast 110, hinge 118, and handle 124, but external to the arm 122.

That is, the cord 128 is enclosed individually by the mast 110, hinge 118 and handle 124 during operation and adjustment while being external and adjacent to the arm 122. Such a combination of internal and external placement of the cord 128 allows for adjustment and operation of the various components of the light assembly 100 without risk of inadvertently snagging or abusing the cord. Hence, safety and efficiency of the light assembly 100 is vastly improved with the cord 128 configuration shown in FIG. 1.

It can be appreciated that the electrical cord 128 can be connected to either a stationary power source or a mobile power source. For example, the cord 128 could be configured to tap power from a wall mounted electrical receptacle or a unitary mobile battery. In the case of a mobile power source, the base 102 can be configured to provide straps to restrict movement and maintain position in the transport region 114 of the base 102. However, the number, size, and orientation of any power source straps is not limited and can be constructed as needed to efficiently supply power to the light assembly 100.

Furthermore, a preferred embodiment of the present invention connects the mast 110 to the bridge 104 with a coupling 130 that allows rotational movement about the bridge 104 while maintaining a sliding relationship with the mast 110. That is, the coupling 130 operates in conjunction with either the deployment region 112 or the transition region 114 to secure the mast 110. As a result, the mast 110 is preferably disengages a region (e.g. 112 or 114) by sliding through the coupling 130 before engaging the opposing region.

Figure 2:
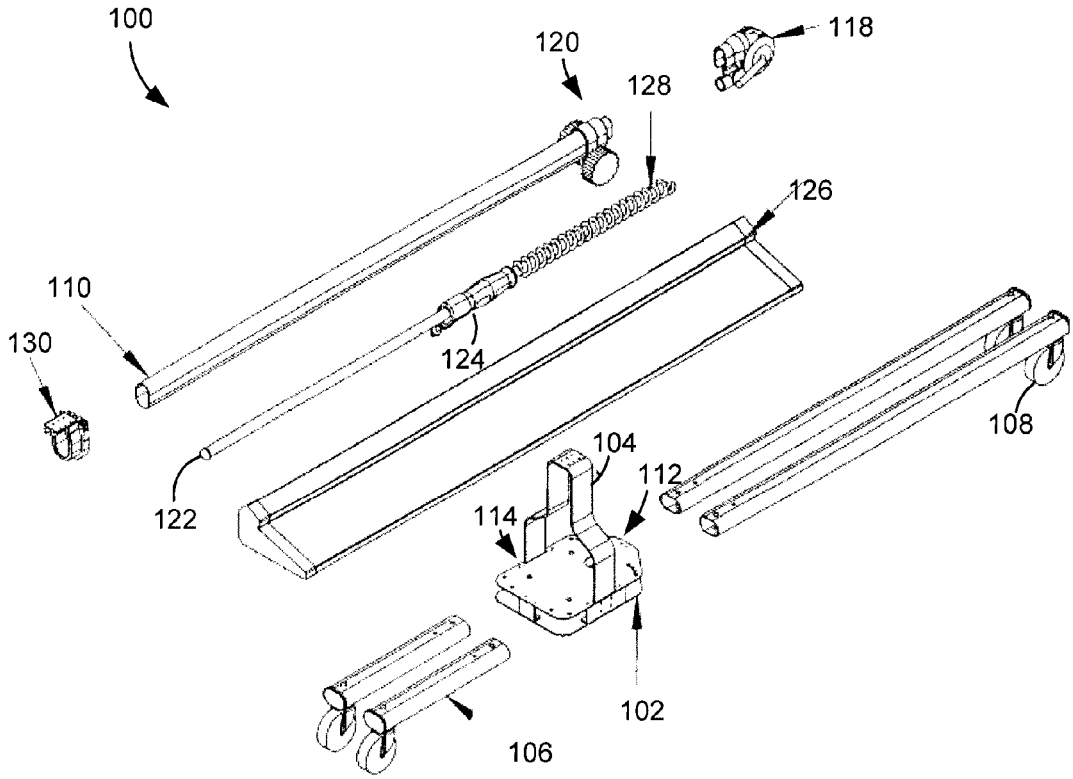
FIG. 2 shows an exploded view of the portable light of FIG. 1.

For clarification, an exploded view of the portable light assembly 100 of FIG. 1 is shown in FIG. 2. It should be noted that the particular orientations, shapes, and sizes of the various components are not limiting and can be modified as necessary to accommodate for the various embodiments of the present invention. Likewise, the number of component is not limiting as members can be added, or subtracted from the assembly 100 without deterring from the spirit of the present invention.

Figure 3:
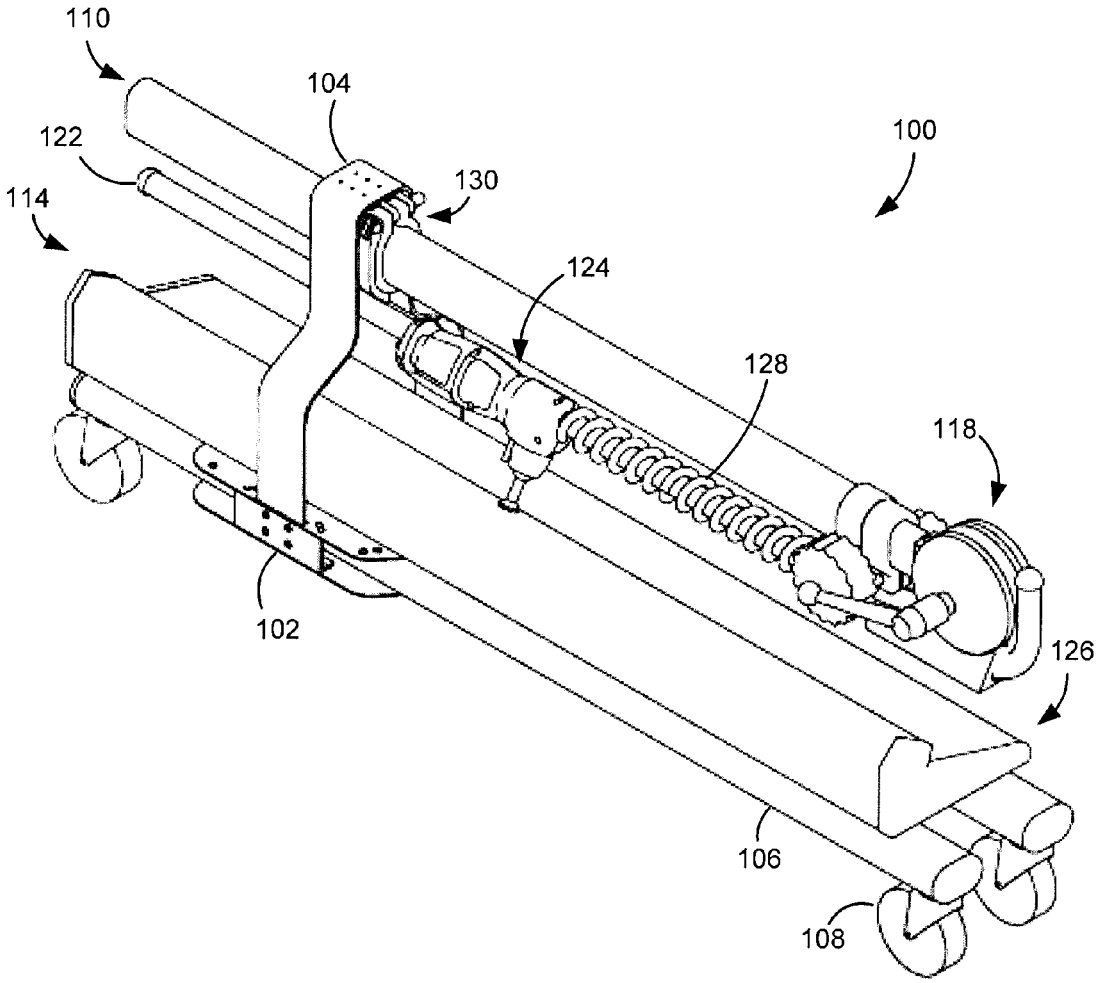
FIG. 3 illustrates the portable light assembly of FIG. 1 in an exemplary transport position in accordance with various embodiments of the present invention.

While the light assembly 100 is depicted in a deployed position in FIG. 1, a transport position is shown in FIG. 3. The light fixture 126 is disposed within the transport region 114 that is preferably defined by the length of the legs 106 and the base 102 in combination with bridge 104. It can be appreciated that the transport region 114 can be various sizes and configurations such without deterring from the spirit of the present invention. Likewise, the bridge 104 can be constructed to any number of configurations that provide protection for the light fixture 126 while in the transport region 114.

As discussed above, the coupling 130 preferably provides a sliding engagement of either the deployment region 112 or the transport region 114. As such, the mast 110 laterally slides into the transport region 114 so that the coupling 130 traverses a portion of the mast 110, in a preferred embodiment. However, it should be noted that the light fixture 126 can be manipulated into the transport region 114 and transported without rotating the coupling 130. For example, the mast 110 can be removed from the coupling 130 and slid into the transport region 126.

Further in various embodiments of the present invention, the light fixture 126 is preferably positioned in the transport region 114 with the light source facing the base 102 and legs 106. As a result, the light source, such as a light bulb, is protected from damage during transportation. Similarly, the arm 122, handle 124, and cord 128 are also protected from abuse during transportation by being disposed within the transport region. That is, the preferred configuration of the light fixture 126 within the transport region 114 positions the arm 122, handle 124, and cord 128 between the mast 110 and the light fixture 126.

Figure 4:
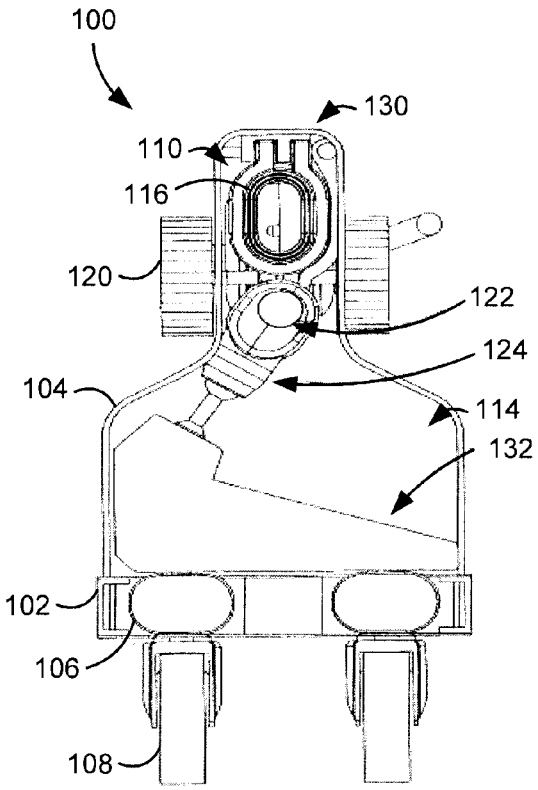
FIGS. 4 and 5 display various exemplary embodiments of the portable light assembly of FIG. 3.
Figure 5:
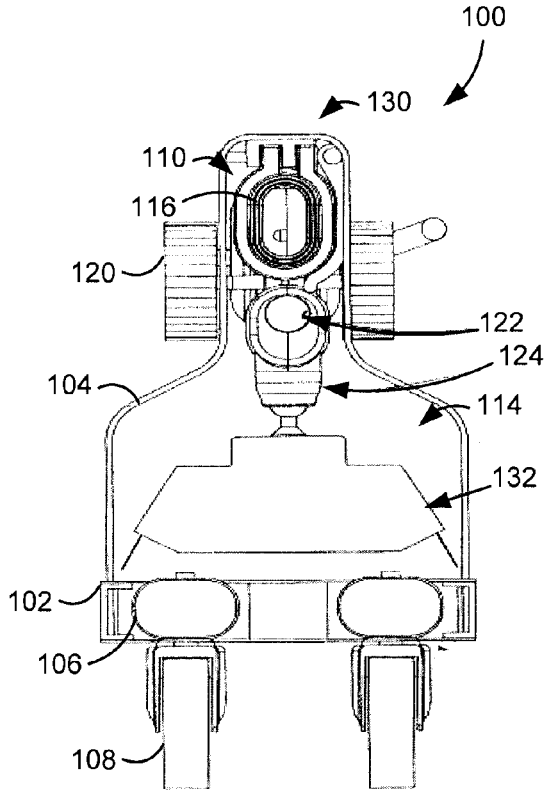

In FIGS. 4 and 5, the portable light assembly 100 of FIGS. 1 and 2 is illustrated in accordance with various embodiments of the present invention. The light fixture 132 is shown disposed within the transport region 114 in an orientation that protects any light source from damage by facing the legs 106 and base 102. It can be appreciated that the configuration of the light fixture 132 is not limited and can be any shape, such as an asymmetrical design, shown in FIG. 3. The ability of the handle 124 to rotate in relation to the arm 122 as well as the ball and socket joint connection of the handle 124 and light fixture 132 allows any shape or size light fixture to be positioned and protected within the transport region 114.

Additionally in FIG. 4, a preferred orientation of the coupling 130, mast 110, and any extensions 116 is displayed. As such, the extensions 116 are positioned within the mast 110 while the mast 110 is enclosed by both the bridge 104 and the coupling 130. However, it should be noted that the bridge 104 and coupling 130 are not required to completely enclose the mast 110 and can surround only a portion of the mast 110 while staying within the intended spirit of the present invention.

In a similar manner, a symmetrically designed light fixture 134 is illustrated in FIG. 5. In contrast to FIG. 4, the symmetrical light fixture 134 requires minimal manipulation of the handle 124 to position the light fixture 134 within the protection of the transport region 114 with the light source facing the legs 106 and base 102. Regardless, the various adjustment capabilities of the components of the light assembly 100 allow virtually any number of light fixture configurations to be positioned within the transport region 114 and provide protection for any light source.

Figure 6:
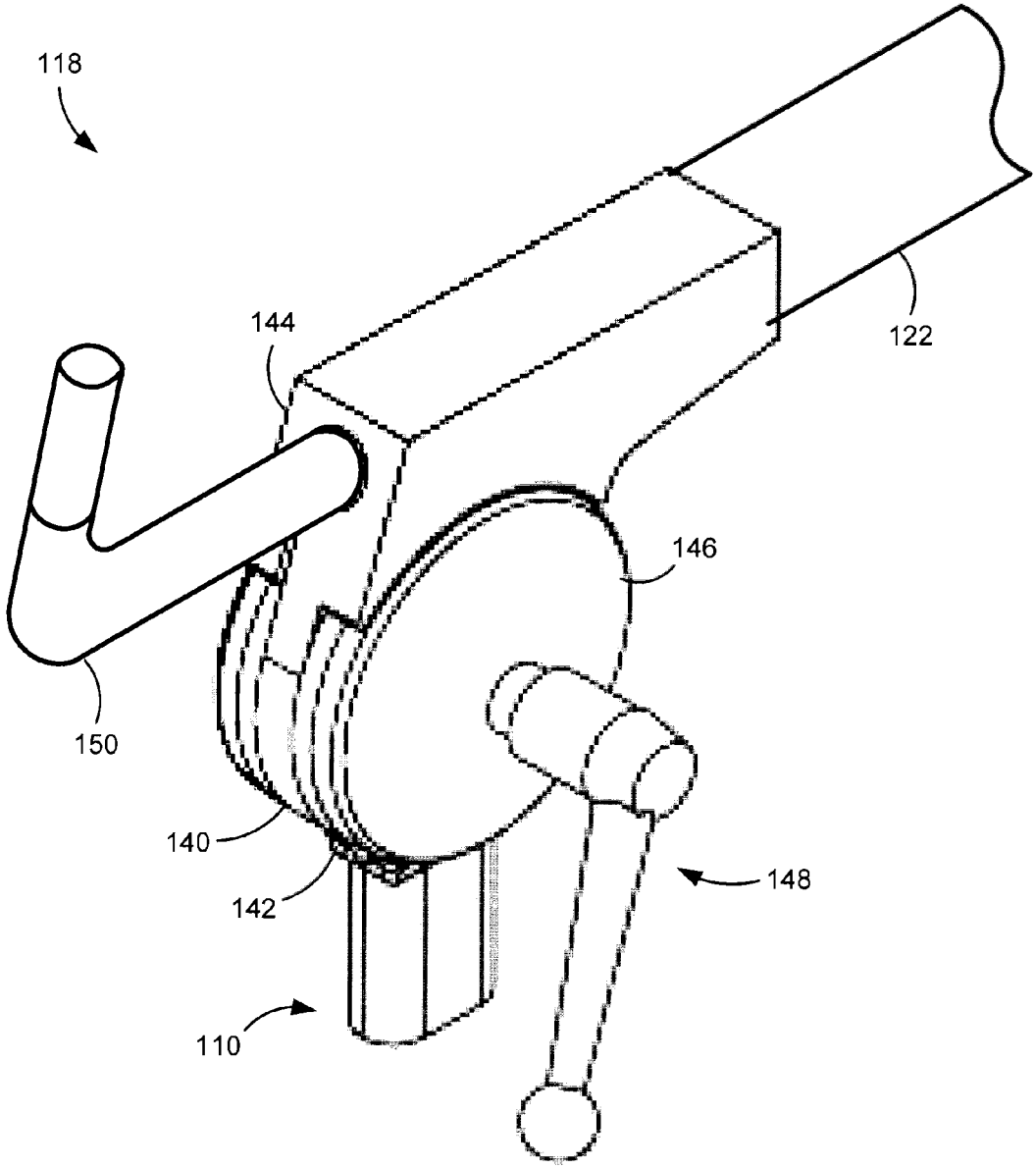
FIG. 6 generally features an exemplary hinge constructed and operated in accordance with various embodiments of the present invention.

To position the light fixture in either the deployed region 112 or the transport region 114, the hinge 118 is preferably utilized to adjust the arm 122 in relation to the mast 110. FIG. 6 displays an exemplary hinge 118 constructed and operated in accordance with various embodiments of the present invention. The hinge 118 provides a first flange 140 connected to the mast 110 in contacting engagement with a second flange 142 connected to the arm 122. In some embodiments, a friction member 144 is disposed between the first and second flanges 140 and 142 to allow retention of a desired arm 122 position with respect to the mast 110.

Further, the first and second flanges 140 and 142 are configured in contacting abutment with a plurality of caps 146. The caps 146 can advantageously aid in the retention of lubrication in the hinge 118 while keeping unwanted particles out of the moving components. To facilitate securement of the arm 122 in relation to the mast 110, a pressure lever 148 capable of applying pressure to the friction member 144 is connected through the hinge 118. However, it should be noted that the use of a lever to apply pressure to the hinge 118 is not limiting as a variety of pressure applications can be utilized to secure the position of the arm 122 with respect to the mast 110.

In an alternative embodiment, a manipulation lever 150 is connected to the second flange 142 to provide efficient precision of any adjustments in the position of the arm 122. It can be appreciated that the manipulation lever 148 can be any number of configurations, sizes, and shapes as desired. While the hinge 118 is shown having an infinite number of adjustable positions in only one plane, the hinge 118 is not limited to a single plane of operation. For example, a rotating joint can be connected to the first flange 140 to allow lateral rotation of the hinge 118 in combination with the vertical rotation shown in FIG. 6.

Figure 7:
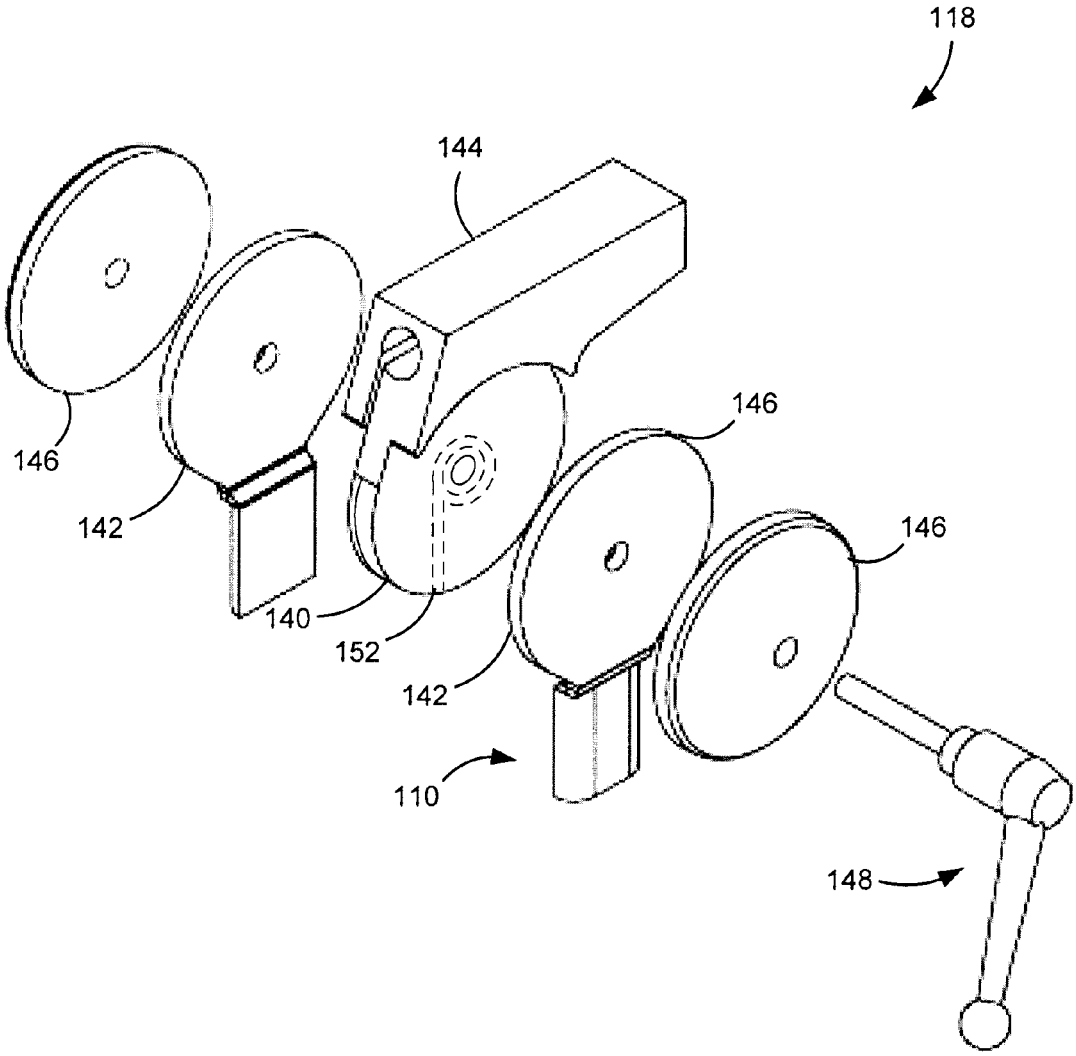
FIG. 7 provides an exploded view of the hinge of FIG. 6.

Turning to FIG. 7, an exemplary exploded view of the hinge 118 of FIG. 5 is illustrated. The friction member 140 preferably includes a recess 152 to which the electrical cord 128 occupies. That is, the cord 128 enters the hinge 118 from a position internal to the mast 110 and remains internal until reaching an external position adjacent the arm 122. The ability to enclose the cord 128 during adjustment and operation of the light assembly 100 provides numerous advantages in safety, efficiency, and performance that cannot be achieved with conventional lights.

In some embodiments, the recess 152 is internal to the friction member 140. As shown by the segmented recess 152, the cord 128 can occupy the recess 152 while being completely enclosed within the friction member 140. Further in various embodiments, the friction member 140 can comprise multiple pieces combine to form the recess 152. In addition, the preferred operation of the friction member 140 provides various adjustment and range of motion while maintaining the cord 128 within the recess 152 of the friction member 140. For example, the friction member 140 can have mirrored interior chambers that allow the cord 128 to enter the member 140 one side and exit the member 140 on the opposing side while remaining internal to the friction member 140 during various adjustments of the hinge 118.

Figure 8:
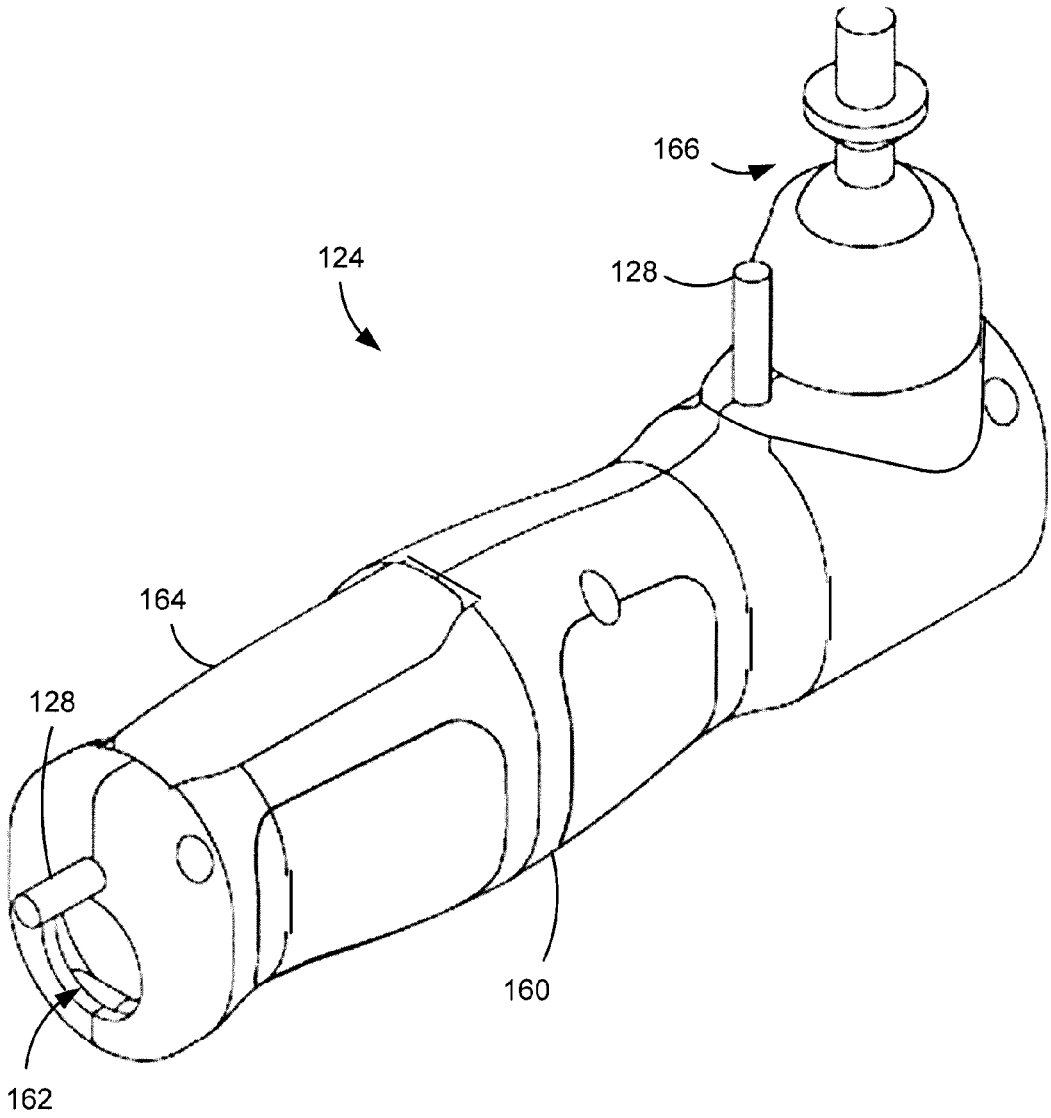
FIG. 8 illustrates an exemplary handle constructed and operation in accordance with various embodiments of the present invention.
Figure 9:
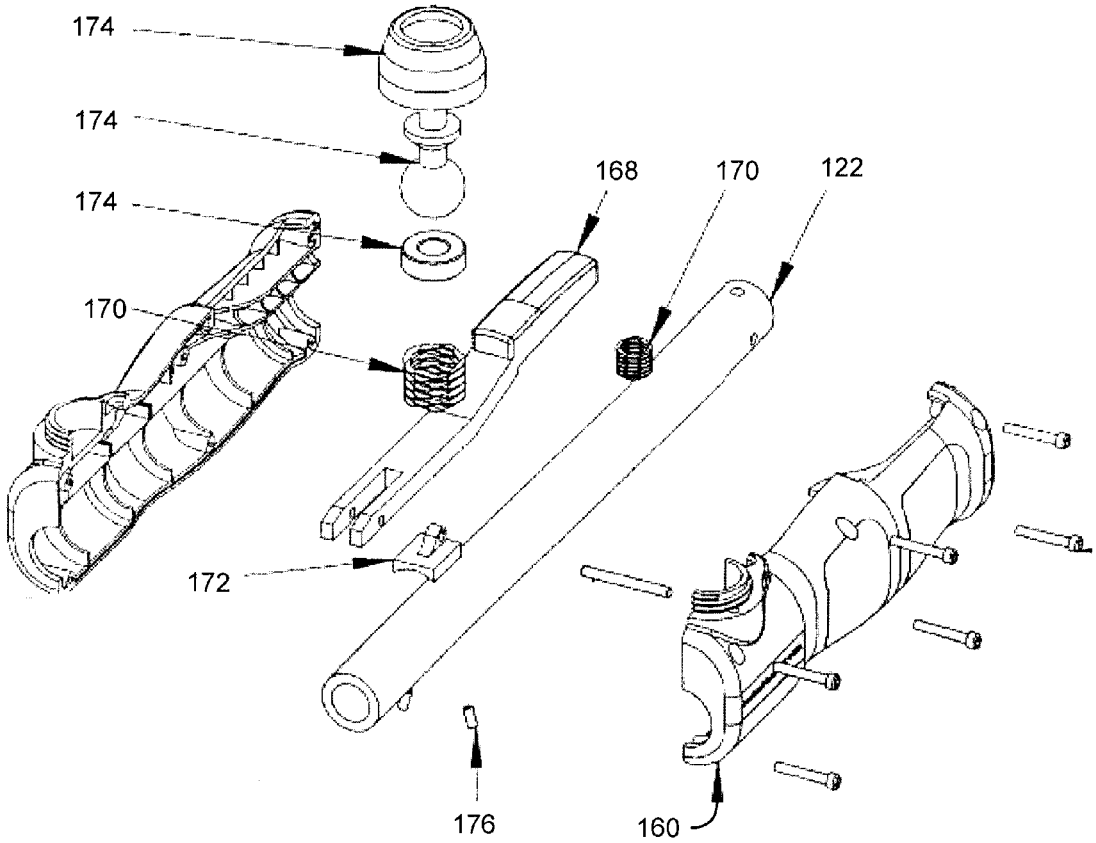
FIG. 9 displays an exploded view of the handle of FIG. 8.

In FIGS. 8 and 9, an exemplary handle 124 is shown constructed and operated in accordance with the various embodiments of the present invention. The handle 124 generally features a body 160 that defines an arm region 162 capable of receiving and securing the arm 122. That is, the arm region 162 preferably extends through the body 160 to allow both lateral and rotational adjustment of the handle 124. In some embodiments, the handle 124 provides compression force on the arm 122 to maintain a desired position until a trigger 164 is selected.

Upon selection, any compression force on the arm 122 is removed and adjustment of the handle 124 is available. Thus, the trigger 164 allows operative selection of adjustment of the handle 124.

It should be noted that the electrical cord 128 transitions from an external position to an internal position throughout the handle 124. However, the cord 128 returns to an external position as it connects to the light fixture. The internal configuration of the cord 128 provides improved performance and safety due to the ability to adjust the handle 124 and light fixture 126 without concern for the location of the cord 128. Such lack of loose entanglements around points of adjustment such as the handle 124, hinge 118, and light fixture 126 ensure precision and safety.

FIG. 9 shows the handle 124 of FIG. 8 in an exemplary exploded view. The trigger 164 is preferably connected to an handle lever 168 that facilitates the application of force on both the arm 122. In various embodiments, a plurality of springs 170 enable the trigger 164 and handle lever 168 to apply sufficient pressure to secure the handle 124 to the arm 122. As for the handle 124 securement to the arm 122, the handle lever 170 preferably forces a friction puck 172 into contacting engagement with the arm 122.

Furthermore, a calibration screw 176 can be adjusted to modify an amount of frictional force applied by the handle 124 to the arm 122. It should be noted that the shape, size, and orientation of the handle 124 is not limited to the design displayed in FIG. 8. Likewise, the manner in which force is applied to the ball and socket joint 166 and the arm 122 is not limited and can be modified as necessary to restrict unwanted movement of the handle 124 and joint 166.

It can be appreciated that the exploded views of FIGS. 2 and 8 are merely clarifying in nature and do not limit the configuration or design of the individual components. As such, various members can be included, or excluded, as necessary to maintain the spirit of the present invention.

Figure 10:
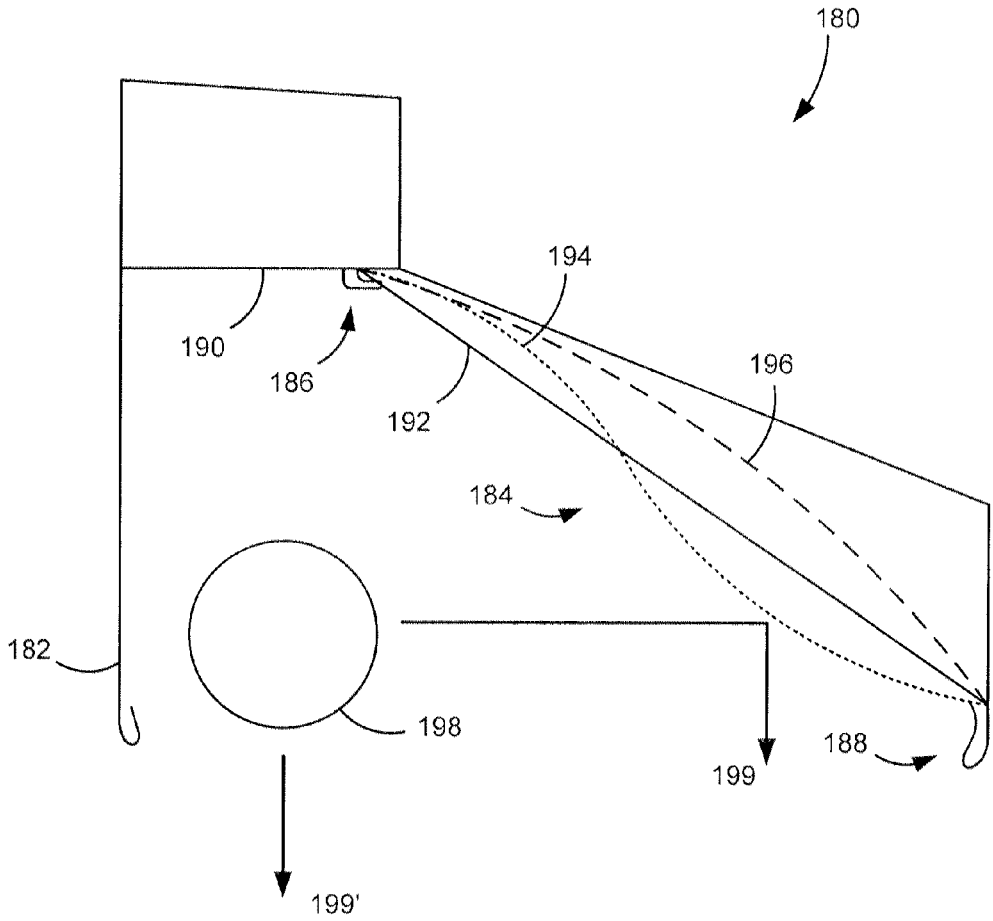
FIG. 10 shows an exemplary light fixture constructed and operated in accordance with various embodiments of the present invention.

Turning now to FIG. 10, an exemplary light fixture 180 is displayed as constructed in accordance with various embodiments of the present invention. The light fixture 180 generally features a body 182 that can be configured in a number of configurations to provide light at various angles. Further, a lens region 184 is defined within the body 182 by a first open hem 186 and a second open hem 188. In some embodiments, the first open hem 186 is connected to a baffle member 190 that can be configured to enclose any electrical components of the light fixture 180 such as, but not limited to, transformers and wires.

Further in various embodiments, a lens 192 can engage and be secured in the lens region 184 without a fastener in a variety of different configurations, shown by segmented lines 194 and 196. That is, a lens 192 can be secured in the lens region 184 by contactingly engaging the first and second open hems 186 and 188 to form a number of different shapes, such as the convex and concave shapes of lenses 194 and the flat shape of lens 192. However, it should be noted that the number and size of open hems is not limited as a single open hem could be facilitated to secure a lens 192.

In addition, the light fixture 180 preferably includes a light source 198, such as a light bulb, that is positioned in front of the lens region 184. To clarify, the light source 198 is positioned so that a lens 192 can only modify indirect light 199. For example, if a green tinted lens 192 is secured in the lens region 184, the light will emit normal colored direct light 199' in combination with green tinted indirect light 199 that reflects off the lens 192. Hence, the placement of the light source 198 at the same elevation as the second open hem 188 advantageously allows a large amount of indirect light to be reflected towards a desired target.

Figure 11:
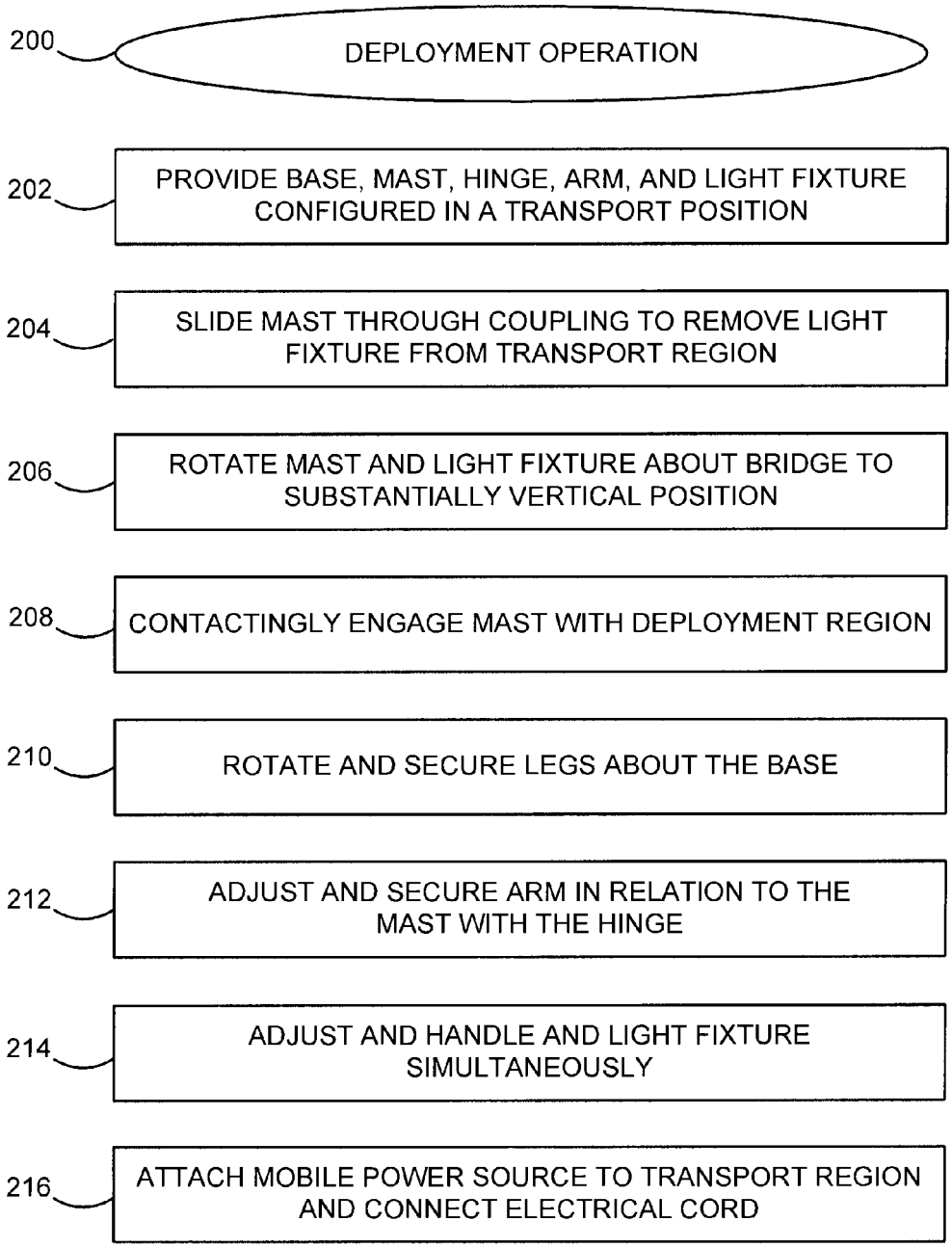
FIG. 11 provides a flow diagram of an exemplary deployment operation performed in accordance with various embodiments of the present invention.

FIG. 11 provides an exemplary deployment operation 200 performed in accordance with various embodiments of the present invention. In step 202, a portable light assembly is provided having at least a base, bridge, mast, hinge, arm, and light fixture. However the number of other components provided in step 202 is not limiting as numerous additional components can be provided. The mast and light fixture are removed from the transport region in step 204 by sliding the mast through the coupling. The mast and light fixture are then rotated around the bridge by the coupling in step 206 to bring the mast to a substantially upright position. However, it should be noted that steps 202 and 204 can be performed simultaneously.

Further in step 208, the mast slides into a contacting engagement with the deployment region to provide support for the mast, arm, and light fixture. A plurality of legs can be rotated about the base in step 210 in order to provided additional support for the base and subsequent components. However, step 210 can be performed at any time during the deployment operation 200 without deterring from the spirit of the present invention.

In addition, the hinge is adjusted and secured in step 212 to provide the arm in a desired position relative to the mast. Step 214 preferably involves selecting, adjusting, and securing the radial and lateral position of the handle as well as the position of the light fixture simultaneously. Finally, in step 216 a mobile power source is attached to the transport region of the base and connected to the cord that supplies power to the light fixture.

It will now be appreciated that the various embodiments presented herein provide various advantages over the prior art. The use of these successive steps in the deployment of the novel portable light assembly can result in significant improvement in efficiency and precision of light production.

It is to be understood that even though numerous characteristics and advantages of various embodiments of the present invention have been set forth in the foregoing description, together with details of the structure and function of various embodiments of the invention, this detailed description is illustrative only, and changes may be made in detail, especially in matters of structure and arrangements of parts within the principles of the present invention to the full extent indicated by the broad general meaning of the terms in which the appended claims are expressed.

What is claims is:

1. A light fixture comprising:

a body with a light source and a first lens region defined by at least one open hem; and a first lens configured to engage the at least one open hem and selectively provide at least two different shapes that reflect indirect light from the light source to a target while the light source emits non-reflected direct light to the target.

2. The light fixture of claim 1, wherein the first lens provides colored indirect light reflection.

3. The light fixture of claim 1, wherein a first different shape of the at least two different shapes is a continuously curvilinear arch.

4. The light fixture of claim 3, wherein a second different shape of the at least two different shapes is a continuously flat plane.

5. The light fixture of claim 3, wherein a second different shape of the at least two different shapes has a plurality of continuously curvilinear arches.

6. The light fixture of claim 1, wherein a first different shape is concave with respect to the light source.

7. The light fixture of claim 6, wherein a second different shape is convex with respect to the light source.

8. The light fixture of claim 1, wherein the first lens has concave and convex different shapes with respect to the light source.

9. The light fixture of claim 1, wherein the lens engages the at least one open hem behind the light source.

10. The light fixture of claim 1, wherein a first open hem is contactingly adjacent a baffle.

11. The light fixture of claim 1, wherein a second open hem is distal a baffle on the body.

12. The light fixture of claim 1, wherein the first lens region is on an opposite side of the light source than a second hem.

13. The light fixture of claim 1, wherein the first lens region has a first lens configured with a first shape and a second lens region has a second lens configured with a different second shape.

14. The light fixture of claim 13, wherein the first lens has a first translucency and the second lens has a different second translucency.

15. The light fixture of claim 13, wherein the first lens has a first color and the second lens has a different second color.

16. The light fixture of claim 1, wherein multiple lens are positioned in the first lens region.

17. A method comprising:

providing a body with a light source and a first lens region defined by at least one open hem;

engaging the at least one open hem with a first lens;

configuring the first lens selectively to at least two different shapes; and activating the light source to reflect indirect light from the first lens to a target while emitting non-reflected direct light to the target.

18. The method of claim 17, wherein all the light generated by the light source is reflected as indirect light.

19. The method of claim 17, wherein the first lens is configured to first and second different shapes, then subsequently configured to at least a third different shape.

20. An apparatus comprising:

a body with a light source, a first open hem, and a second open hem;

a first lens configured to engage the first and second open hems and selectively provide at least two different shapes that reflect indirect light from the light source to a target; and a second lens configured to engage the first and second open hems and selectively provide a third different shape to reflect indirect light from the light source to the target while the light source emits non-reflected direct light to the target.

* * * * *